US009251975B1

(12) United States Patent
Brandau

(10) Patent No.: US 9,251,975 B1
(45) Date of Patent: Feb. 2, 2016

(54) APPARATUS INCLUDING A PUSH-BUTTON WITH A COMPRESSIBLE MEMBER

(71) Applicant: Google Technology Holdings LLC, Mountain View, CA (US)

(72) Inventor: Mark R. Brandau, Johns Creek, GA (US)

(73) Assignee: Google Technology Holdings LLC, Mountain View, CA (US)

( * ) Notice: Subject to any disclaimer, the term of this patent is extended or adjusted under 35 U.S.C. 154(b) by 0 days.

(21) Appl. No.: 14/476,243

(22) Filed: Sep. 3, 2014

(51) Int. Cl.

| | |
|---|---|
| ***H01H 1/02*** | (2006.01) |
| ***H01H 13/14*** | (2006.01) |
| ***H01H 13/04*** | (2006.01) |
| ***H01H 13/10*** | (2006.01) |

(52) U.S. Cl.
CPC ..... *H01H 13/14* (2013.01); *H01H 13/04* (2013.01); *H01H 13/10* (2013.01); *H01H 2221/044* (2013.01); *H01H 2227/00* (2013.01)

(58) Field of Classification Search
CPC ..... H01H 1/029; H01H 13/702; H01H 1/403; H01H 13/186; H01H 13/14; H01H 21/22; H01H 13/18; H01H 3/022; A41D 1/002; A63H 3/36
USPC ..... 200/511, 329, 330, 332, 335, 341, 343
See application file for complete search history.

(56) References Cited

U.S. PATENT DOCUMENTS

| | | | | |
|---|---|---|---|---|
| 5,813,520 | A | 9/1998 | Reier et al. | |
| 7,238,906 | B2 * | 7/2007 | Michel | H01H 13/12 200/329 |
| 8,493,742 | B2 | 7/2013 | Li et al. | |
| 2007/0261945 | A1 * | 11/2007 | Tan | H01H 13/06 200/329 |
| 2010/0059349 | A1 * | 3/2010 | Wuestenbecker | H03K 17/962 200/314 |

* cited by examiner

*Primary Examiner* — Edwin A. Leon
(74) *Attorney, Agent, or Firm* — Faegre Baker Daniels LLP

(57) ABSTRACT

An apparatus including a switch and a push-button coupled to the switch. The push-button can include a push-button head including a push-button face and a contact portion opposite from the push-button face. An applied force can move the push-button head in an actuation direction in a switch actuation plane relative to the switch to actuate the switch. The contact portion can actuate the switch when the applied force moves the push-button head in the actuation direction. The push-button can also include a compressible member that compresses in a compression plane parallel with and offset from the switch actuation plane. The compressible member can include a first end coupled to the push-button head and a second end opposite from the first end. The second end can be coupled to a fixed point relative to the switch.

20 Claims, 5 Drawing Sheets

APPARATUS INCLUDING A PUSH-BUTTON WITH A COMPRESSIBLE MEMBER

BACKGROUND

1. Field

The present disclosure is directed an apparatus including a push-button with a compressible member. More particularly, the present disclosure is directed to an apparatus including a push-button that has a compressible member that is offset from a switch actuation plane that reduces the space required by the push-button.

2. Introduction

Presently, portable electronic devices have push-buttons that users press to activate functions and features of the electronic devices. For example, a smartphone uses a home key that a user presses to activate the home screen of the smartphone. As another example, a music player includes volume buttons that a user presses to change the volume of the music player. As a further example, a camera includes a shutter button that a user presses to take a picture. To be as portable as possible, the electronic devices are relatively small to fit in a user's hand, in a user's pocket or on a user's body. Due to size constraints, components of an electronic device are tightly packaged into the device's housing to make a device as portable as possible.

Unfortunately, the size constraints make it a challenge to fit all of the desired components into the device while keeping the device small and portable. The size makes it especially challenging to incorporate push-buttons into the device because push-buttons require extra space for movement of the button and for springs to return a push-button to its original position after the push-button is pressed.

Thus, there is a need for an apparatus with a push-button having a compressible member that reduces the space required by the push-button.

BRIEF DESCRIPTION OF THE DRAWINGS

In order to describe the manner in which advantages and features of the disclosure can be obtained, a description of the disclosure is rendered by reference to specific embodiments thereof which are illustrated in the appended drawings. These drawings depict only example embodiments of the disclosure and are not therefore to be considered to be limiting of its scope.

DETAILED DESCRIPTION

Embodiments provide an apparatus with a push-button having a compressible member that reduces the space required by the push-button. According to a possible embodiment the apparatus includes a switch and a push-button coupled to the switch. The push-button can include a push-button head including a push-button face and a contact portion opposite from the push-button face. An applied force can move the push-button head in an actuation direction in a switch actuation plane relative to the switch to actuate the switch. The contact portion can actuate the switch when the applied force moves the push-button head in the actuation direction. The push-button can also include a compressible member that compresses in a compression plane parallel with and offset from the switch actuation plane. The compressible member can include a first end coupled to the push-button head and a second end opposite from the first end. The second end can be coupled to a fixed point relative to the switch.

Figure 1:
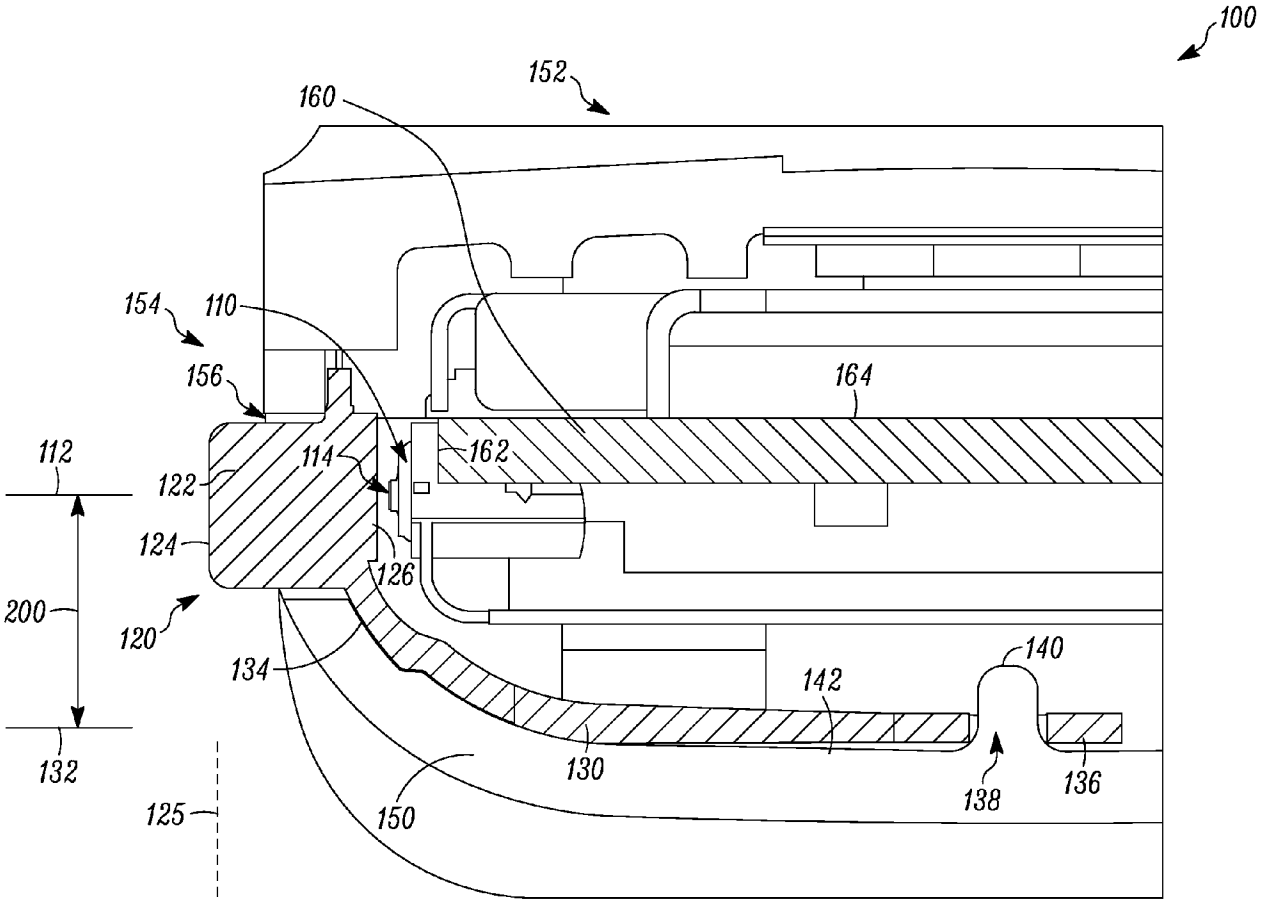
FIG. 1 is an example illustration of a section of an apparatus according to a possible embodiment.

FIG. 1 is an example illustration of a section of an apparatus 100 according to a possible embodiment. The apparatus 100 can be an electronic device, a camera, a hand held electronic device, a cellular phone, a smart watch, smart glasses, a camera, a tablet computer, or any other device that can use a push-button. Only a section of the apparatus 100 is shown for simplicity of describing the relevant features of the apparatus 100. The apparatus 100 can include a switch 110 and a push-button 120 coupled to the switch.

Figure 2:
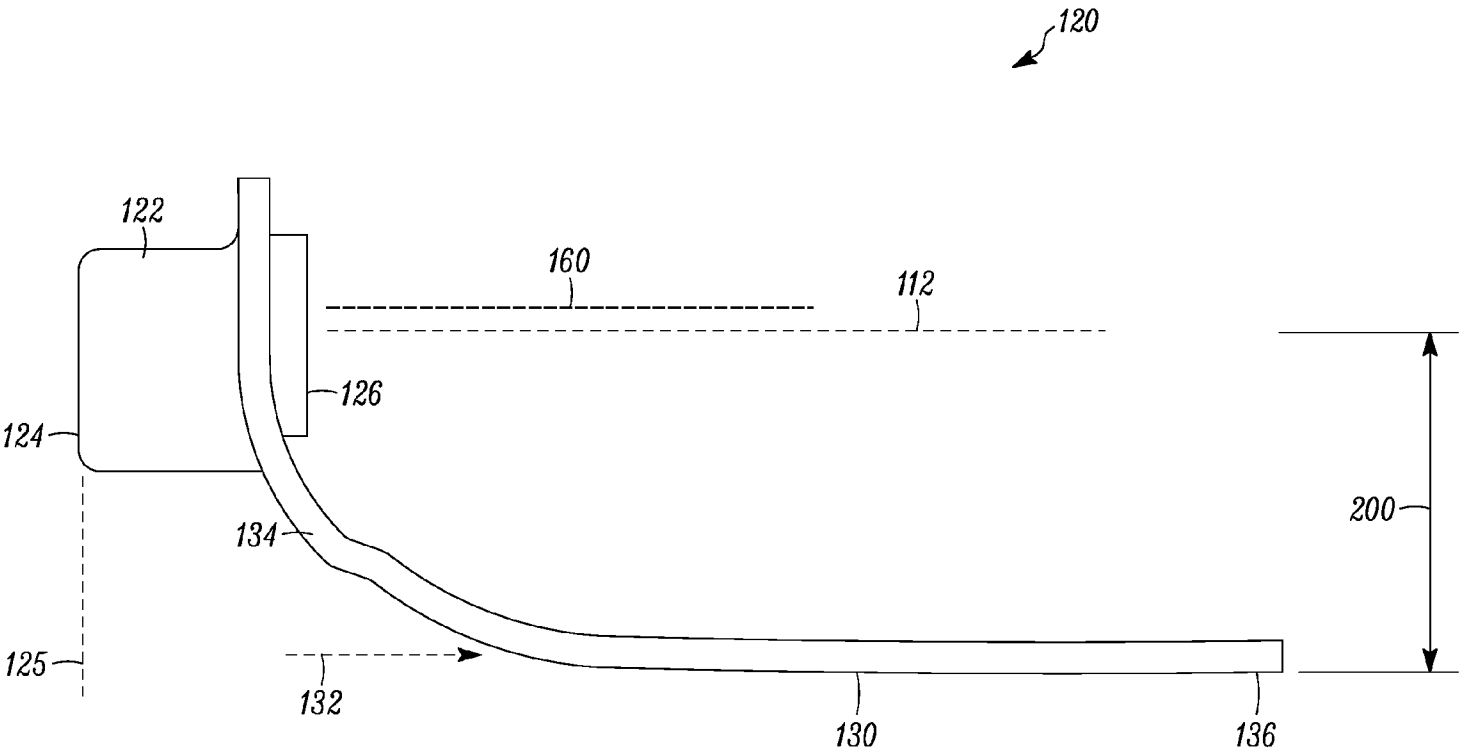
FIG. 2 is an example illustration of a push-button according to a possible embodiment.

FIG. 2 is an example illustration of the push-button 120 according to a possible embodiment that will be described in conjunction with FIG. 1. The push-button 120 can include a push-button head 122 including a push-button face 124 and a contact portion 126 opposite on the head 122 from the push-button face 124. The push-button face 124 can be in a push-button face plane 125 perpendicular to the compression plane 132. While the push-button face 124 is shown as substantially flat, the push-button face 124 may also be curved or have angles while still being in a push-button face plane 125 perpendicular to the compression plane 132. An applied force can move the push-button head 122 in an actuation direction in a switch actuation plane 112 relative to the switch 110 to actuate the switch 110. The contact portion 126 can actuate the switch 110 when the applied force moves the push-button head 122 in the actuation direction.

The push-button 120 can also include a compressible member 130 that compresses in a compression plane 132 parallel with and offset 200 from the switch actuation plane 112. The compressible member 130 can be unitary with the push-button head 122, such as made of the same material or in the same mold, or can a separate element coupled to the push-button head 122. The compressible member can include a first end 134 coupled to the push-button head 122 and a second end 136 opposite from the first end 134. The second end 136 can be coupled to a fixed point 140 relative to the switch 110. For example, the compressible member 130 can include an aperture 138 and the fixed point 140 can be a fixed support rib 140. The aperture 138 can encircle the fixed support rib 140. The fixed support rib 140 can couple the compressible member 130 to a fixed point relative to the switch 110. The fixed support rib 140 can be a protrusion that comes from a base wall 142 and the fixed support rib 140 can extend up from the base wall 142 orthogonal to a plane of the base wall 142. The second end 136 can also be coupled to the fixed point 140 using other options of affixing a compressible member to a fixed point, such as by using a heat stake, glue, a post, a boss, or other options for affixing a compressible member to a fixed point. According to a possible embodiment, the switch 110 can have a switch face 114 that contacts the push-button contact portion 126 and the compressible member 130 can extend beyond the switch face 114 and/or beyond the entire switch 110 in a direction parallel with the actuation direction of the applied force in the switch actuation plane 112.

The distance between the push-button head 122 and the fixed point 140 can accomplish a linear translation motion of the push-button head 122 along the switch actuation plane 112 using the compressible member with the offset 200 rather than rotating or pivoting the push-button head 122. This can provide an evenly applied force normal or orthogonal to the push-button face 124 and the switch face 114 for more reliable actuation of the switch 110 and for switch longevity. Otherwise a side, rotational, or off axis force, such as from a button that pivots, can produce less reliable switch actuation and can produce a shear force that damages the switch 110.

The apparatus 100 can also include an apparatus housing 150 coupled to the push-button 120 and the switch 110 and a printed circuit board 160 encased within the apparatus housing 150 and electrically coupled to the switch 110. The printed circuit board 160 can have a printed circuit board side 162 and a printed circuit board face 164 perpendicular to the printed circuit board side 162. The printed circuit board face 164 can be in a printed circuit board face plane parallel with the switch actuation plane 112 and parallel with and offset from the compression plane 132. The fixed support rib 140 can be located central to the push-button 120 below the printed circuit board 160 and can provide a reaction force for the compressible member 130 to drive the push-button 120 away from the switch 110 when the applied force is no longer present.

The apparatus housing 150 can have an outer housing face 152 and an outer housing side 154 perpendicular with the outer housing face 152. The outer housing side 154 can have a push-button aperture 156, where the push-button 120 can be disposed within the push-button aperture 156. Alternately, the push-button 120 can be located in an aperture on the housing face 152 or elsewhere on a housing.

The apparatus housing 150 can include an inner housing surface, such as the base wall 142, and the compressible member 130 can be contoured along the inner housing surface. For example, the compressible member 130 can be a deflection beam contoured to the apparatus housing 150 while being offset relative to the printed circuit board 160 to minimize clearance needed between the printed circuit board side 162 and/or other components and the housing 150. The compressible member 130 can be positioned and offset in from the printed circuit board 160 and the switch 110, which can reduce space requirements of the push-button and can reduce clearance between the push-button 120 and the switch 110. For example, clearance can be reduced because a spring, foam, rubber, and/or other restoration material is not necessary between the push button 120 and a supporting surface about the switch 110. Thus, the number of items in the mechanical stack up between the switch 110 and the push-button 120 can be reduced to minimize space needed within the housing 150.

Figure 3:
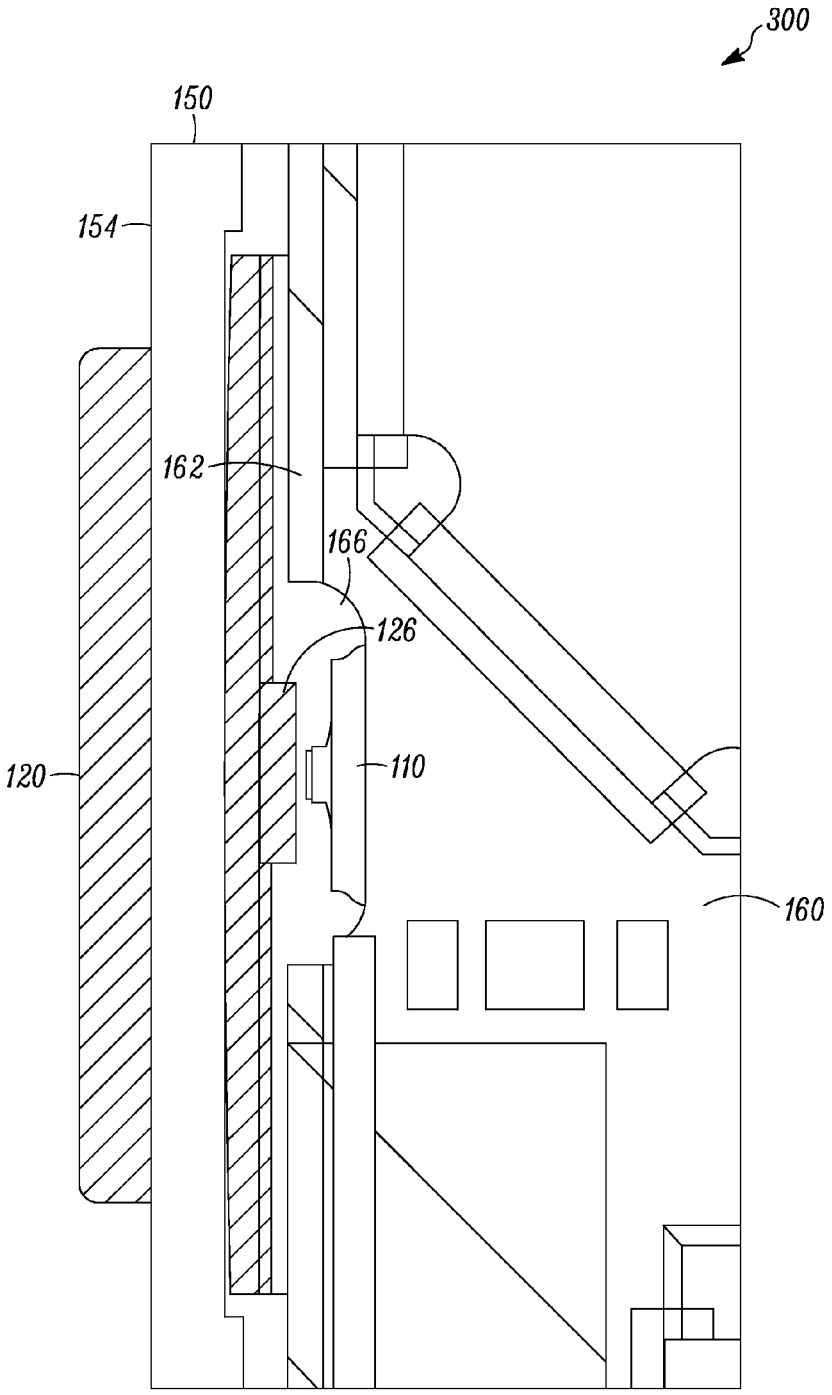
FIG. 3 is an example illustration of a section of an apparatus according to a possible embodiment.

FIG. 3 is an example illustration of a section 300 of the apparatus 100 according to a possible embodiment. The section 300 can include the switch 100, the push button 120, the printed circuit board 160, the housing 150, and the housing side 154. The printed circuit board 160 can include cut out 166 in the printed circuit board side 162. The switch 110 can be disposed within the cut out 166 and the push-button contact portion 126 can extend into the cut out 166 to actuate the switch 110.

Figure 4:
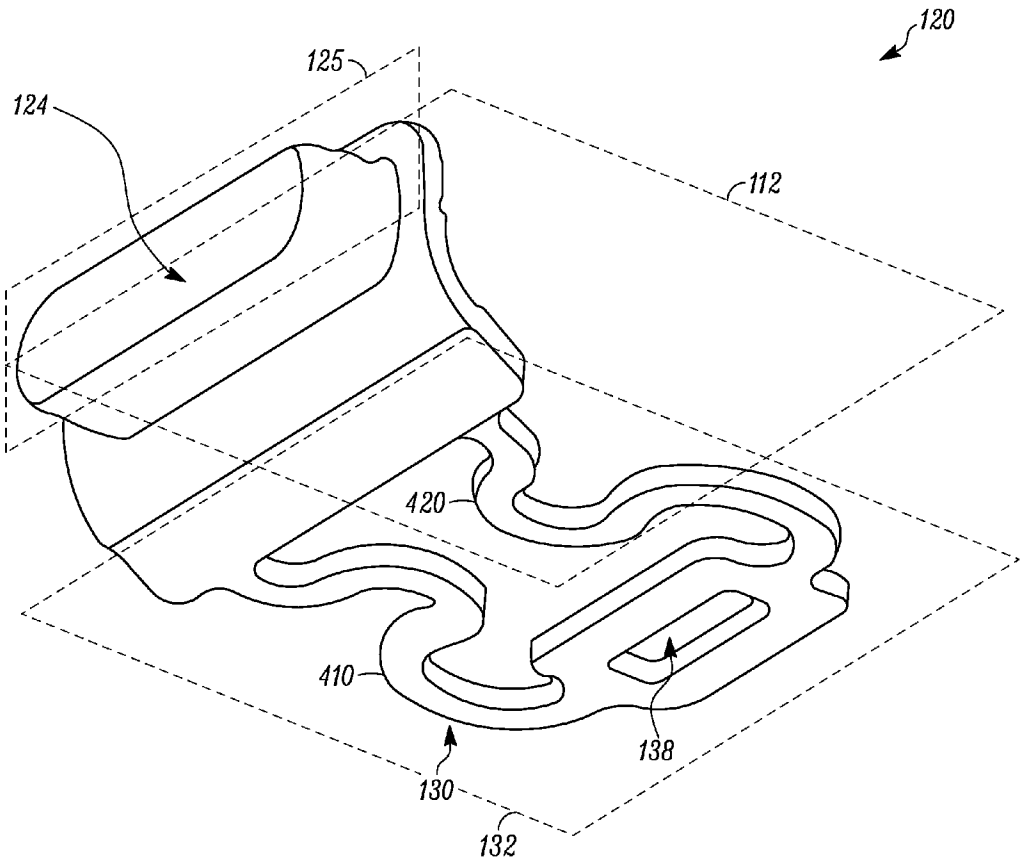
FIG. 4 is an example orthogonal view of a push-button according to a possible embodiment.
Figure 5:
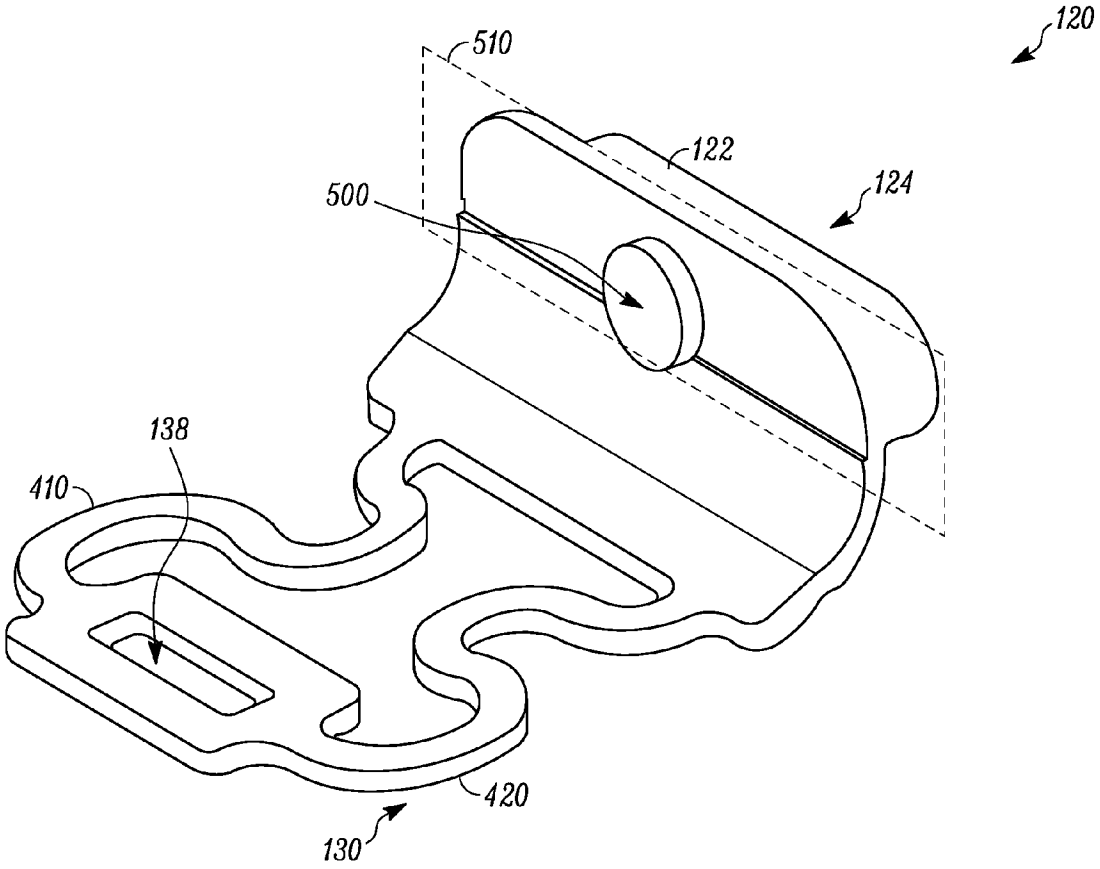
FIG. 5 is an example orthogonal view of a push-button according to a possible embodiment.

FIGS. 4 and 5 are example orthogonal views of the push-button 120 according to a possible embodiment. The push-button 120 can include the compressible member 130, the aperture 138, the push-button head 122, and the push-button face 124. The compressible member 130 can include a first s-shaped deflection beam 410 that is s-shaped in the compression plane 132 and a second s-shaped deflection beam 420 that is s-shaped in the compression plane 132, where the first s-shaped deflection beam 410 and the second s-shaped deflection beam 420 compress in the compression plane 132 offset from and parallel with the switch actuation plane 112. The push-button head 122 can include a push button head center 500 in a plane 510 parallel with the push-button face plane 125. The s-shaped deflection beams 410 and 420 can be symmetrical about the push-button head center 500. The deflection beams 410 and 420 also can be curved, can be c-shaped, can have additional curves along with the s-shape, can be angular, or can be any other compressible deflection beams. For example, more curves or larger curves in deflection beams can increase flexibility, but can reduce the amount of restoration force. More linear deflection beams can increase restoration force, but are not as flexible. The use of different materials, such as different plastics, can also provide reduced or increased flexibility and reduced or increased restoration force.

Embodiments can provide button return force when there is minimal space available for component actuation. Otherwise, size constraints eliminate virtually all clearance between the printed circuit board and the housing side. Embodiments can provide better tactile feedback for a user by avoiding the use of other material between push button and switch. While button restoration materials, such as rubber gasket, foam, spring, etc., may be used, they are not necessary as they absorb the tactile feel of the switch, such as the click of the switch.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the disclosed embodiments. For example, one of ordinary skill in the art of the disclosed embodiments would be enabled to make and use the teachings of the disclosure by simply employing the elements of the independent claims. Accordingly, embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. The phrase "at least one of" followed by a list is defined to mean one, some, or all, but not necessarily all of, the elements in the list. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising." Furthermore, the background section is written as the inventor's own understanding of the context of some embodiments at the time of filing and includes the inventor's own recognition of any problems with existing technologies and/or problems experienced in the inventor's own work.

I claim:

1. An apparatus comprising:

a switch; and a push-button coupled to the switch, where the push-button comprises:

a push-button head including a push-button face and a contact portion opposite from the push-button face, where an applied force moves the push-button head in an actuation direction in a switch actuation plane relative to the switch to actuate the switch, where the contact portion actuates the switch when the applied force moves the push-button head in the actuation direction; and a compressible member that compresses in a compression plane parallel with and offset from the switch actuation plane, the compressible member including a first end coupled to the push-button head and a second end opposite from the first end, the second end coupled to a fixed point relative to the switch.

2. The apparatus according to claim 1, wherein the push-button face is in a push-button face plane perpendicular to the compression plane.

3. The apparatus according to claim 1, wherein the switch comprises a switch face that contacts the push-button contact portion, and wherein the compressible member extends beyond the switch face in a direction parallel with the actuation direction of the applied force.

4. The apparatus according to claim 1, wherein the compressible member comprises a first s-shaped deflection beam that is s-shaped in the compression plane and a second s-shaped deflection beam that is s-shaped in the compression plane, where the first s-shaped deflection beam and the second s-shaped deflection beam compress in the compression plane offset from and parallel with the switch actuation plane.

5. The apparatus according to claim 4, wherein the push-button head comprises a push-button face in a push-button face plane perpendicular to the compression plane, where the push-button head includes a push button head center in a plane parallel with the push button face, where the s-shaped deflection beams are symmetrical about the push-button head center.

6. The apparatus according to claim 1, further comprising:

an apparatus housing coupled to the push-button and the switch; and a printed circuit board encased within the apparatus housing and electrically coupled to the switch, where the printed circuit board has printed circuit board sides and a printed circuit board face perpendicular to the printed circuit board sides, where the printed circuit board face is in a printed circuit board face plane parallel with the switch actuation plane and parallel with and offset from the compression plane.

7. The apparatus according to claim 6, wherein the apparatus housing comprises an inner housing surface, and wherein the compressible member is contoured along the inner housing surface.

8. The apparatus according to claim 6, wherein the apparatus housing comprises an outer housing face; and an outer housing side perpendicular with the outer housing face, the outer housing side having a push-button aperture, where the push-button is disposed within the push-button aperture.

9. The apparatus according to claim 6, wherein the printed circuit board comprises a cut out in one of the printed circuit board sides, and wherein the push-button contact portion extends into the cut out to actuate the switch.

10. The apparatus according to claim 1, wherein the compressible member is unitary with the push-button head.

11. An apparatus comprising:

a switch; and a push-button coupled to the switch, where the push-button comprises:

a push-button head including a push-button face and a contact portion opposite from the push-button face, where an applied force moves the push-button head in an actuation direction in a switch actuation plane relative to the switch to actuate the switch, and where the contact portion actuates the switch when the applied force moves the push-button head; and a compressible member that compresses in a compression plane parallel with and offset from the switch actuation plane, the compressible member including a first end coupled to the push-button head and a second end opposite from the first end, the second end coupled to a fixed point relative to the switch, where the compressible member includes at least one curved deflection beam that is curved in the compression plane, where the at least one curved deflection beam compresses in the compression plane offset from and parallel with the switch actuation plane, where the curved deflection beam compresses in the actuation direction.

12. The apparatus according to claim 11, wherein the push-button face is in a push-button face plane perpendicular to the compression plane.

13. The apparatus according to claim 11, wherein the switch comprises a switch face that contacts the push-button contact portion, and wherein the compressible member extends beyond the switch face in a direction parallel with the actuation direction of the applied force.

14. The apparatus according to claim 11, wherein the at least one curved deflection beam comprises a first s-shaped deflection beam that is s-shaped in the compression plane and a second s-shaped deflection beam that is s-shaped in the compression plane, where the first s-shaped deflection beam and the second s-shaped deflection beam compress in the compression plane offset from and parallel with the switch actuation plane.

15. The apparatus according to claim 14, wherein the push-button head comprises a push-button face in a push-button face plane perpendicular to the compression plane, where the push-button head includes a push button head center in a plane parallel with the push button face, where the s-shaped deflection beams are symmetrical about the push-button head center.

16. The apparatus according to claim 11, further comprising:

an apparatus housing coupled to the push-button and the switch; and a printed circuit board coupled to the housing and electrically coupled to the switch, where the printed circuit board has printed circuit board sides and a printed circuit board face perpendicular to the printed circuit board sides, where the printed circuit board face is in a printed circuit board face plane parallel with the switch actuation plane and parallel with and offset from the compression plane.

17. The apparatus according to claim 16, wherein the apparatus housing comprises an inner housing surface, and wherein the compressible member is contoured along the inner housing surface.

18. The apparatus according to claim 16, wherein the apparatus housing comprises an outer housing face; and an outer housing side perpendicular with the outer housing face, the outer housing side having a push-button aperture, where the push-button is disposed within the push-button aperture.

19. The apparatus according to claim 16, wherein the printed circuit board comprises a cut out in one of the printed circuit board sides, and wherein the push-button contact portion extends into the cut out to actuate the switch.

20. An apparatus comprising:

a housing including a housing face, a housing side perpendicular to the housing face, and a push-button aperture in the housing side;

a switch disposed within the housing; and a push-button disposed in the push-button aperture and coupled to the switch, where an applied force moves the push-button in an actuation direction in a switch actuation plane relative to the switch to actuate the switch, where the push-button comprises:

a push-button head including a push-button face and a contact portion opposite from the push-button face, where an applied force moves the push-button head in an actuation direction in a switch actuation plane relative to the switch to actuate the switch, and where the contact portion actuates the switch when the applied force moves the push-button head, where the push-button face is in a push-button face plane perpendicular to the compression plane; and a compressible member that compresses in a compression plane parallel with and offset from the switch actuation plane, the compressible member including a first end coupled to the push-button head and a second end opposite from the first end, the second end coupled to a fixed point relative to the switch, where the compressible member includes at least one curved deflection beam that is curved in the compression plane, where the at least one curved deflection beam compresses in the compression plane offset from and parallel with the switch actuation plane, where the curved deflection beam compresses in the actuation direction.

* * * * *